US005613413A

United States Patent [19]

Huang

[11] Patent Number: 5,613,413

[45] Date of Patent: Mar. 25, 1997

[54] HANDLE OF A HAND TOOL

[76] Inventor: Chiu-Hua Huang, P.O. Box 82-144, Taipei, Taiwan

[21] Appl. No.: 603,374

[22] Filed: Feb. 20, 1996

[51] Int. Cl.[6] ..... B25G 1/08

[52] U.S. Cl. ..... 81/490; 81/438; 81/177.4; 81/177.85

[58] Field of Search ..... 81/177.4, 177.85, 81/438, 490

[56] References Cited

U.S. PATENT DOCUMENTS

| | | | |
|---|---|---|---|
| 3,455,355 | 7/1969 | McLogan et al. | 81/438 |
| 4,227,430 | 10/1980 | Jansson et al. | 81/177.4 |
| 5,499,562 | 3/1996 | Feng | 81/177.4 |

FOREIGN PATENT DOCUMENTS

| | | | |
|---|---|---|---|
| 3400068 | 7/1985 | Germany | 81/177.4 |

*Primary Examiner*—James G. Smith
*Attorney, Agent, or Firm*—Alfred Lei

[57] ABSTRACT

A handle for a hand tool, including a hollow handle body and a cover covered on the handle body at the bottom, wherein the handle body has a bottom chamber, an inside annular groove around the bottom chamber, a hexagonal coupling hole longitudinally disposed at the front end in communication with the bottom chamber, a transverse hole perpendicularly extending from the hexagonal coupling hole to the periphery, and a springy strip suspending in the transverse hole adjacent to the hexagonal coupling hole, the springy strip having a raised portion facing the hexagonal coupling hole for holding down a driving shaft in the hexagonal coupling hole for holding a tool bit; the cover has a plurality of split upright barrels for holding tool bits, two arched connecting walls connected between the split upright barrels, and a circular chamber defined within the arched connecting walls for holding a driving shaft, each of the split upright barrels having a transverse rib forced into engagement with the inside annular groove of the handle body.

1 Claim, 5 Drawing Sheets

HANDLE OF A HAND TOOL

BACKGROUND OF THE INVENTION

1. Field of the Invention

This invention relates to hand tools, and relates more particularly to the handle of a hand tool for example a screwdriver which has storage chambers inside the bottom cover thereof for holding the driving shaft and a set of tool bits.

2. Description of the Prior Art

FIG. 1 shows a screwdriver according to the prior art which is comprised of a handle, a driving shaft, and a set of screwdriver bits. The handle is comprised of a cylindrical handle body and two end caps. The cylindrical handle body has a longitudinal center through hole, which holds the driving shaft when the screwdriver is collapsed, and a plurality of hexagonal recesses at two opposite ends around the longitudinal through hole for receiving the screwdriver bits, two outer threads at two opposite ends, and a transverse coupling hole for mounting the driving shaft in the operative position. Each of the end cap has an inner thread for threading onto one outer thread of the handle body. This structure of tool handle is complicated. When the screwdriver bits are stored in the hexagonal recesses of the handle body, they cannot be conveniently removed from the handle body.

SUMMARY OF THE INVENTION

This invention relates to hand tools, and relates more particularly to the handle of a hand tool for example a screwdriver which has storage chambers inside the bottom cover thereof for holding the driving shaft and a set of tool bits.

It is one object of the present invention to provide a tool handle which has inside chambers for storing the driving shaft and the tool bits when the hand tool is collapsed. It is another object of the present invention to provide a tool handle having inside chambers for storing the driving shaft and the tool bits which holds the driving shaft and the tool bits in a conveniently accessible manner.

According to one aspect of the present invention, the tool handle is comprised of a hollow handle body, and a cover covered on the bottom end of the handle body, wherein the cover has a plurality of upright barrels for storing the tool bits, and a circular chamber surrounded by the upright barrels for storing the driving shaft.

According to another aspect of the present invention, the handle body has a bottom chamber and an inside annular groove around the bottom chamber, the cover has a plurality of ribs raised around the upright barrels and forced into engagement with the inside annular groove of the handle body.

According to still another aspect of the present invention, the upright barrels have longitudinal splits so that they are respectively compressed inwards when inserted into the bottom chamber of the handle body, and force the respective ribs outwards into engagement with the inside annular groove of the handle body after the insertion.

According to still another aspect of the present invention, the handle body has a hexagonal coupling hole for holding the driving shaft in the operative position, a transverse hole perpendicularly extending from the hexagonal coupling hole to the periphery, and a springy strip with a raised portion suspending in the transverse hole adjacent to the hexagonal coupling hole for holding down the driving shaft in the hexagonal coupling hole.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
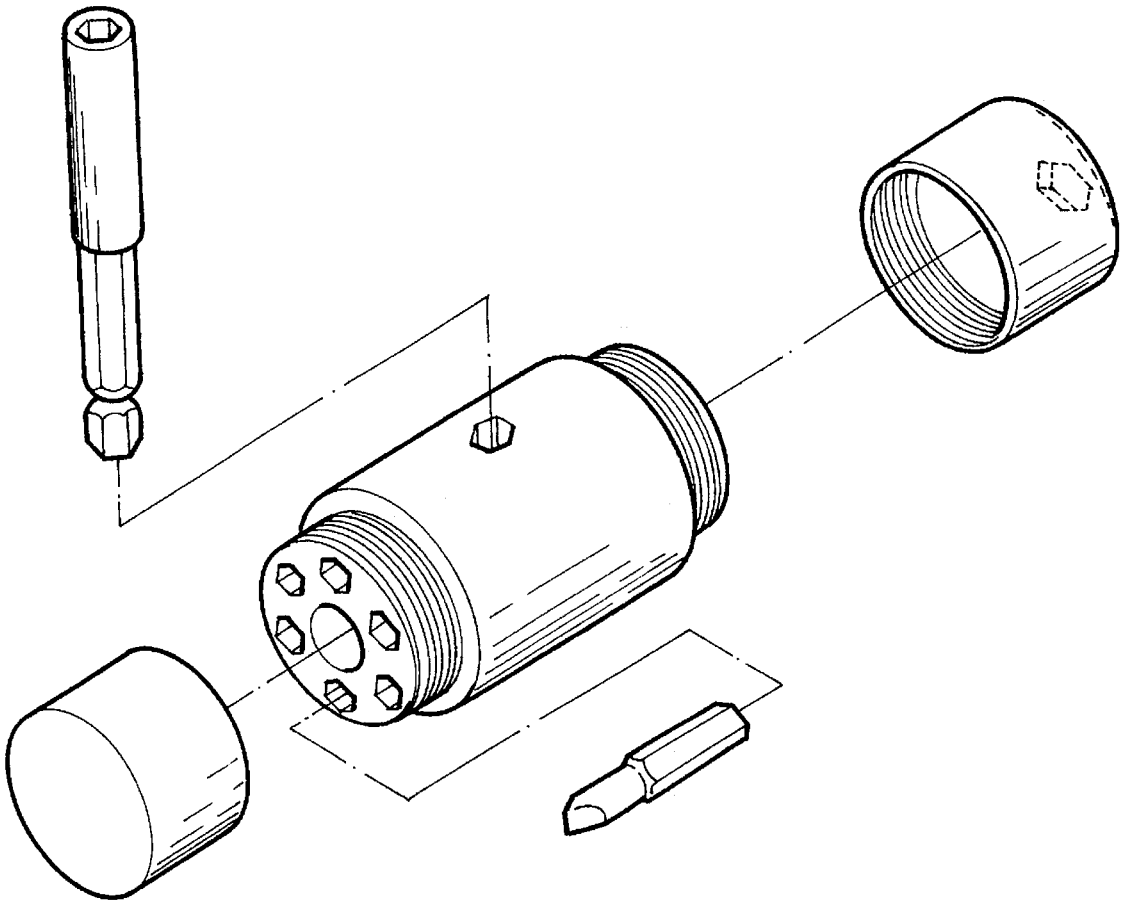
PRIOR ART FIG. 1
FIG. 1 is an exploded view of a tool handle according to the prior art.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
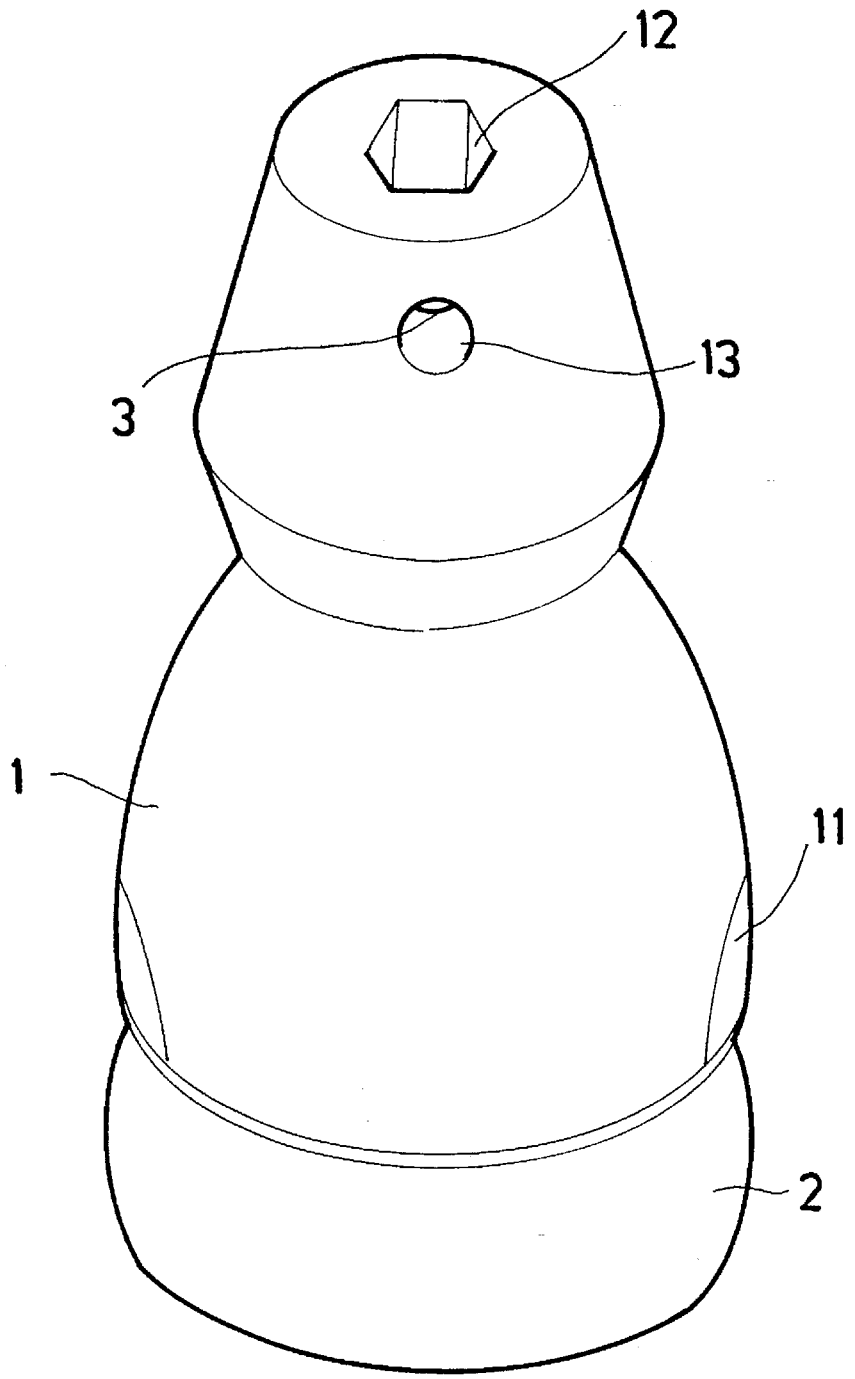
FIG. 2 is an elevational view of a tool handle according to the present invention.
Figure 3:
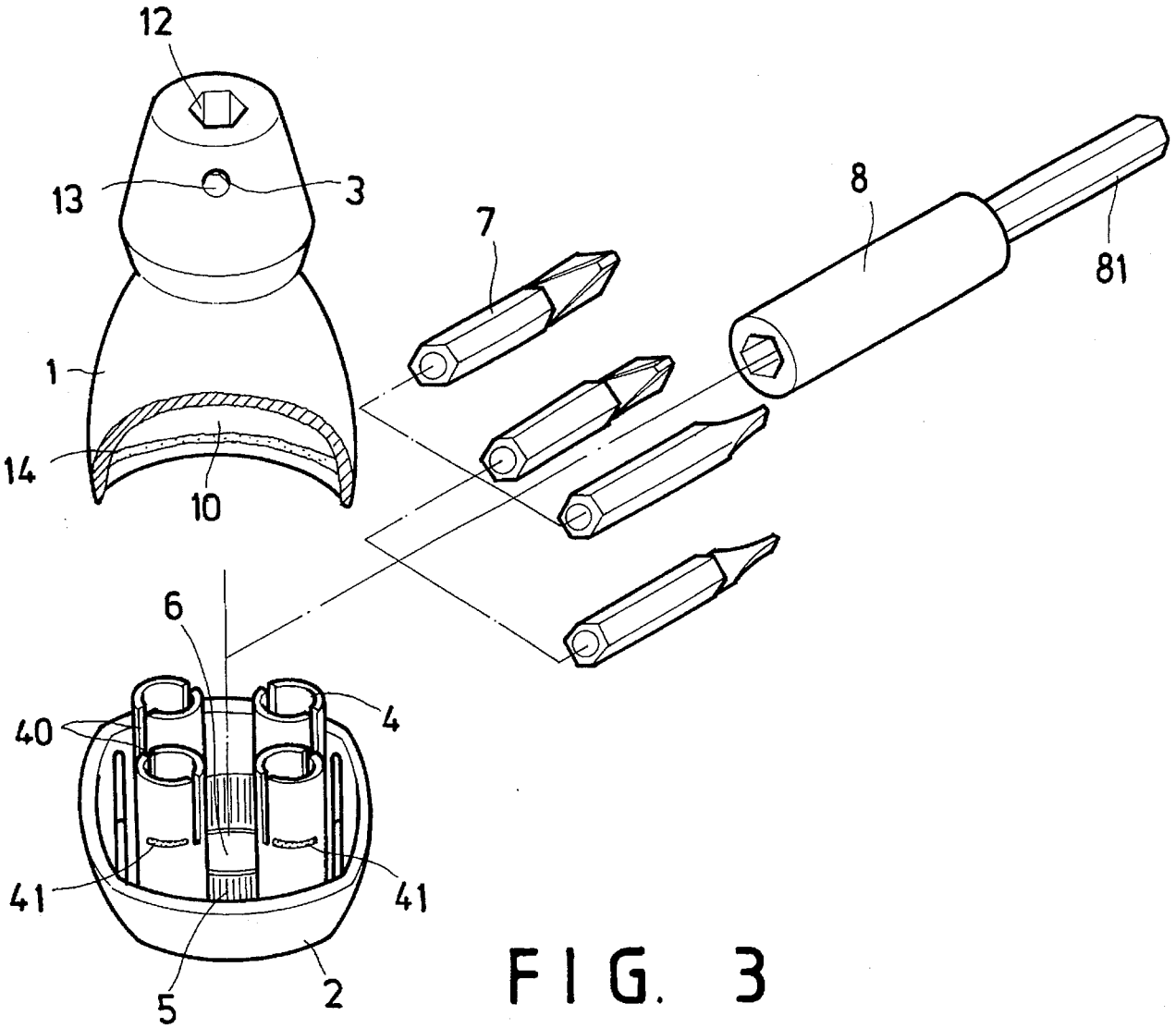
FIG. 3 is an exploded view of the tool handle shown in FIG. 2, and the related driving shaft and tool bits.
Figure 4:
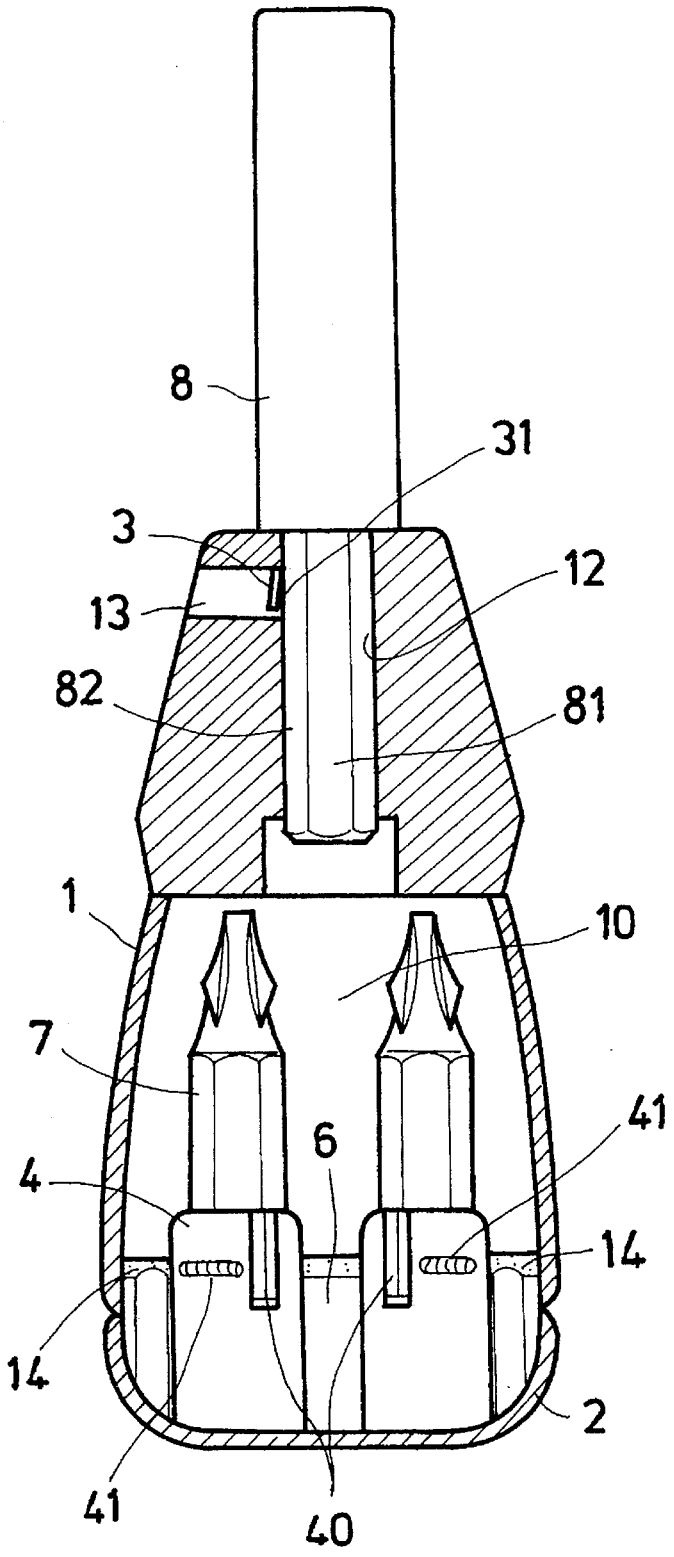
FIG. 4 is a sectional view of the tool handle shown in FIG. 2, showing the driving shaft coupled to the hexagonal coupling hole outside the handle body.

Referring to FIGS. 2, 3, and 4, the handle of a screwdriver in accordance with the present invention is generally comprised of a hollow handle body 1, and a cover 2. The handle body 1 has a bottom chamber 10, an inside annular groove 14 around the bottom chamber 10, a hexagonal coupling hole 12 longitudinally disposed at the front end in communication with the bottom chamber 10, a transverse hole 13 perpendicularly extending from the hexagonal coupling hole 12 to the periphery, a springy strip 3 suspending in the transverse hole 13 adjacent to the hexagonal coupling hole 12, and two opposite press portions 11 on the outside wall near the bottom end. The springy strip 3 has a raised portion 31 facing the hexagonal coupling hole 12. The cover 2 has a cup-like shape, a plurality of upright barrels 4, two arched connecting walls 5 connected between the upright barrels 4, and a circular chamber 6 defined within the arched connecting walls 5. Each of the upright barrels 4 has a transverse rib 41 around the periphery, and a plurality of longitudinal splits 40 extending to the top. A set of screwdriver bits 7 are respectively stored in the upright barrels 4. A driving shaft 8 is stored in the circular chamber 6. When the screwdriver bits 7 and the driving shaft 8 are respectively stored in the upright barrels 4 and a circular chamber 6 of the cover 2, the cover 2 is fastened to the handle body 1 and covered on the bottom chamber 10 by forcing the ribs 41 of the upright barrels 4 into engagement with the inside annular groove 14 of the handle body 1.

Figure 5:
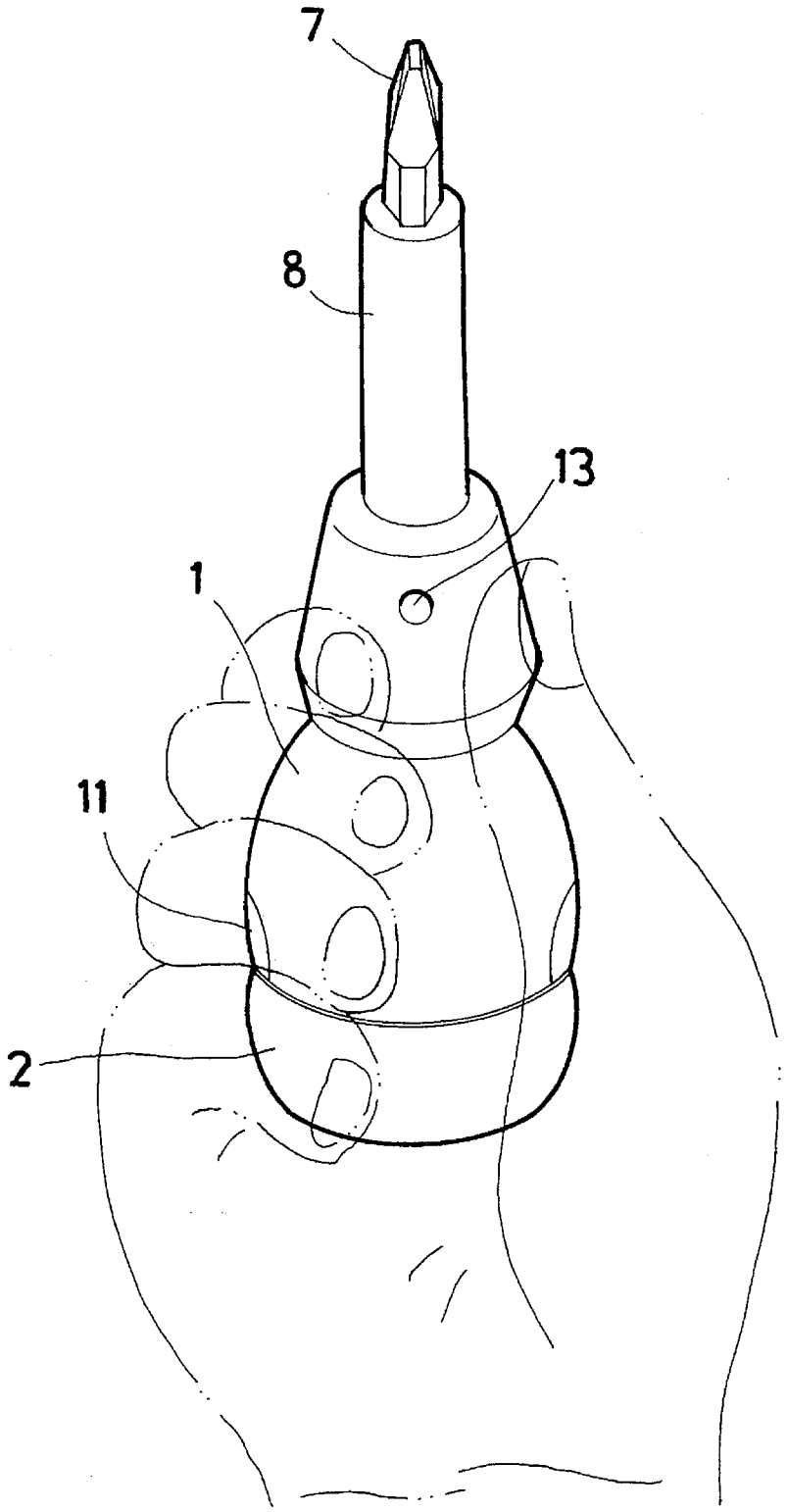
FIG. 5 shows the driving shaft coupled to the hexagonal coupling hole outside the handle body, and a screwdriver bit fastened to the driving shaft according to the present invention.

Referring to FIG. 5 and FIGS. 2 and 3 again, by squeezing the two opposite press portions 11 to deform the bottom end of the handle body 1, the cover 2 can be conveniently disconnected from the handle body 1. The driving shaft 8 has a hexagonal coupling rod 81 for coupling to the hexagonal coupling hole 12 of the handle body 1. When the hexagonal coupling rod 81 of the driving shaft 8 is inserted into the hexagonal coupling hole 12 of the handle body 1, the spring force of the springy strip 3 forces the raised portion 31 into engagement with one side 82 of the hexagonal coupling rod 81 of the driving shaft 8, and therefore the driving shaft 8 is firmly retained to the handle body 1, and a screwdriver bit 7 can be attached to the driving shaft 8 for turning screw bolts, nuts, etc.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A handle for a hand tool, comprising: a handle body having a bottom chamber at a bottom end thereof, an inside annular groove around said bottom chamber, a hexagonal coupling hole longitudinally disposed at a front end thereof in communication with said bottom chamber, a transverse hole perpendicularly extending from said hexagonal coupling hole to the periphery, a springy strip suspending in said transverse hole adjacent to said hexagonal coupling hole, and two opposite press portions on the outside near the bottom end, said springy strip having a raised portion facing said hexagonal coupling hole for holding down a driving shaft in said hexagonal coupling hole for holding a tool bit; and a cover fastened to said handle body and covered on said bottom chamber, said cover comprising a plurality of split upright barrels for holding tool bits, two arched connecting walls connected between said split upright barrels, and a circular chamber defined within said arched connecting walls for holding a driving shaft, each of said split upright barrels having a transverse rib forced into engagement with the inside annular groove of said handle body; wherein said cover can be disconnected from said handle body by disengaging the transverse rib of each of said split upright barrels from the inside annular groove of said handle body by squeezing said press portions to deform the bottom end of said handle body.

* * * * *